US005890937A

United States Patent [19]

Granger

[11] Patent Number: 5,890,937

[45] Date of Patent: Apr. 6, 1999

[54] PROPELLER SHROUD

[76] Inventor: Roger A. Granger, 20321 Shadow Mountain Rd., Walnut, Calif. 91789

[21] Appl. No.: 84,485

[22] Filed: May 26, 1998

[51] Int. Cl.[6] ..... B63H 5/16

[52] U.S. Cl. ..... 440/71; 440/67

[58] Field of Search ..... 440/66, 67, 71, 440/72; 114/166

[56] References Cited

U.S. PATENT DOCUMENTS

| | | | |
|---|---|---|---|
| 123,629 | 12/1872 | Hemje | 440/71 |
| 2,139,594 | 12/1938 | Kort | 114/166 |
| 2,655,891 | 10/1953 | Gorski | 440/67 |
| 3,082,728 | 3/1963 | Dawes | 114/166 |
| 4,832,634 | 5/1989 | Kearns | 440/67 |

FOREIGN PATENT DOCUMENTS

| | | | |
|---|---|---|---|
| 2634724 | 2/1990 | France | 440/71 |

*Primary Examiner*—Ed L. Swinehart
*Attorney, Agent, or Firm*—Edgar W. Averill, Jr.

[57] ABSTRACT

A propeller shroud affixable around the propeller of a water craft. The shroud has a generally cylindrical member which closely surrounds the outer periphery of the blades of the propeller. The front edge of the shroud is deeply concaved to reduce water resistance. Preferably the shroud has several reinforcing blades which are vertically oriented when viewed from the front, but angled rearwardly from the top of the shroud to the bottom. The shroud protects the propeller against damage from rocks, sandbars and the like.

6 Claims, 2 Drawing Sheets

PROPELLER SHROUD

BACKGROUND OF THE INVENTION

The field of the invention is water craft and the invention relates more particularly to devices to protect the propellers of water craft. Various shrouds have been placed around propellers for various reasons in the prior art. U.S. Pat. No. 123,629 shows a hollow cylindrical device used solely to steer a motorboat with an inboard motor.

A propeller assembly having an annular rim 46 is shown in U.S. Pat. No. 3,377,978. The propeller is driven by contact with a pneumatic tire.

A propeller mount for ice breakers is shown in U.S. Pat. No. 4,428,735. The propellers of the ice breaker are protected by a shield 11.

The U.S. Pat. No. 4,680,017 shows a propeller guard on an outboard motor. The propeller guard is held to the motor by a shield which goes over the cavitation plate.

The U.S. Pat. No. 4,746,314 shows a combined propulsion and steering system for a boat with an inboard engine. The Levi device has an arch-like deflector tunnel over the propeller.

Lastly, an article at Page 96 of the March 1992 issue of *Boating World* describes an outboard motor having a "Kort nozzle" held over the propeller for the purpose of increasing boat speed, particularly for heavy boats at slow speeds.

The propellers of motorboats are often damaged by contact with sandbars, shallow bottoms, rocks and debris. This is especially true for the propellers of houseboats since houseboats are typically piloted from the front of the houseboat where it is difficult to see the depth of the water under the propeller. It is also desirable to increase the efficiency of a propeller, particularly at low speeds.

SUMMARY OF THE INVENTION

It is an object of the present invention to provide a propeller shroud for protecting the propeller of a water craft while improving the efficiency of the water craft.

The present invention is for a propeller shroud affixable around the propeller of a water craft. The shroud has a generally cylindrical body with an exterior surface and an interior passageway having a central axis and an interior surface. The generally cylindrical member has a front edge, a rear edge, a top surface and a bottom surface. The front edge is shaped so that a side profile exhibits a deep concave shaped front edge. The cylindrical member is provided with means for affixing the same about a propeller. Preferably one or more inlet blades which are positioned vertically when viewed from the front or rear of the shroud are affixed at the front edge both to strengthen the shroud and to ward off large objects from entering the shroud.

DESCRIPTION OF THE PREFERRED EMBODIMENTS

Figure 1:
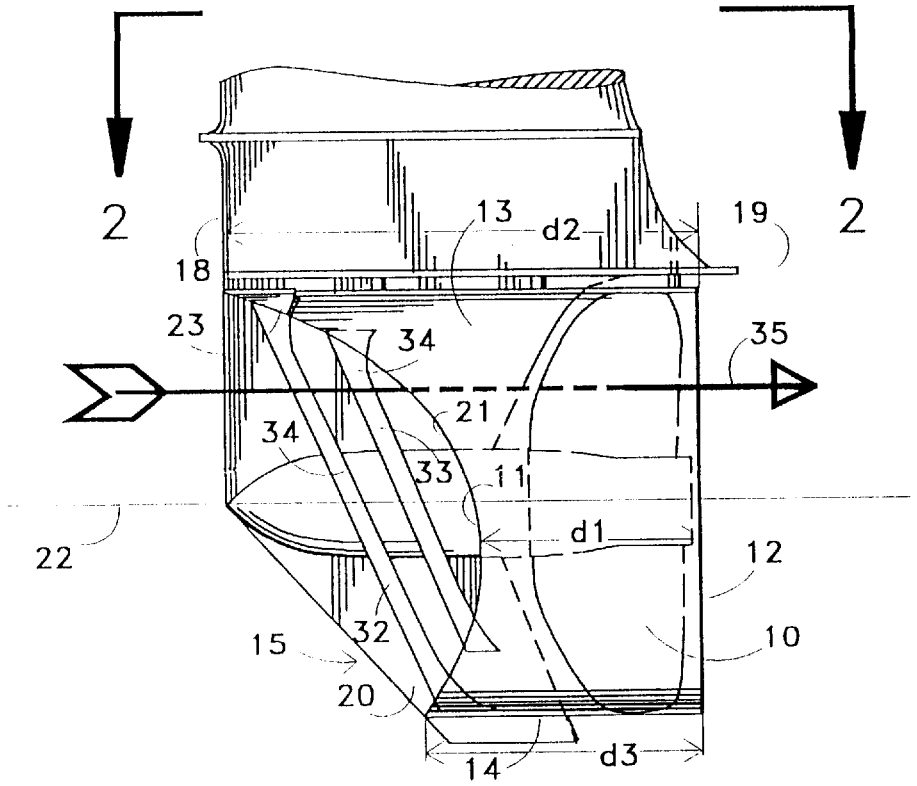
FIG. 1 is a side view of the propeller shroud of the present invention affixed around a propeller of an outboard motor.
Figure 2:
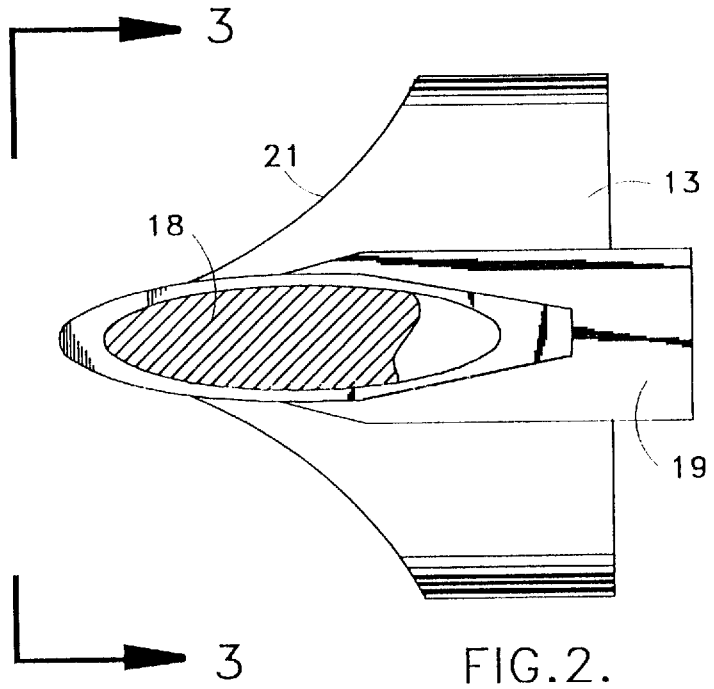
FIG. 2 is a top view taken along line 2—2 of FIG. 2.
Figure 3:
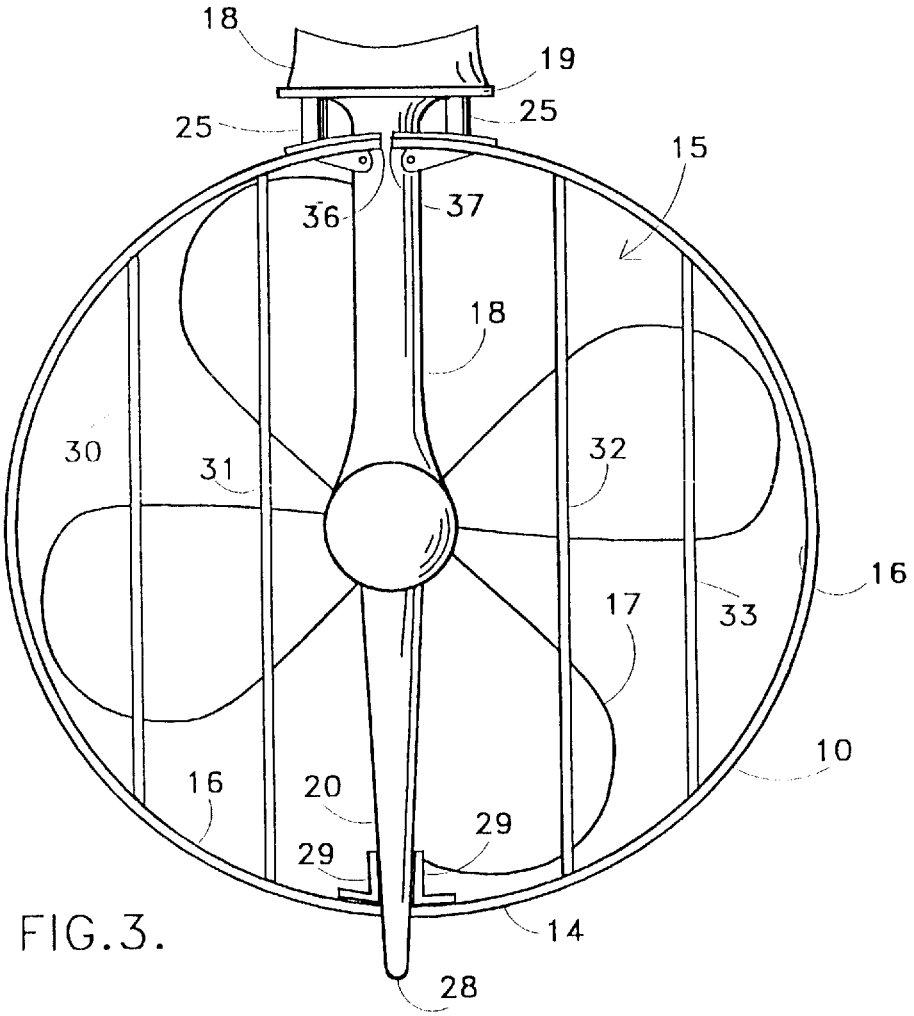
FIG. 3 is a front view taken along line 3—3 of FIG. 1.

A propeller shroud is shown mounted around the propeller of an outboard motor and the shroud is indicated generally by reference character 10 in FIG. 1. Shroud 10 has a front edge 11, a rear edge 12, a top surface 13 and a bottom surface 14. The shroud has an interior passageway 15 which has an interior surface 16. Shroud 10 is generally cylindrical as shown in FIGS. 2 and 3 and its inner surface is close to the tip of propeller 17. Propeller 17 is held at the base of drive shaft housing 18 which is conventional. An anticavitation plate 19 is positioned near the top surface 13. The drive shaft housing 18 supports a skeg 20 to which the shroud 10 is affixed as described in more detail below.

The front edge 11 of shroud 10 has a deeply concaved surface 21. This is an important feature of the present invention and greatly increases the efficiency of the shroud of the present invention. The minimum length between the front edge 11 and rear edge 12 is indicated by reference character d1. The length of the top surface is indicated in FIG. 1 by reference character d2. d1 is preferably less than half of d2. In a preferred embodiment the d1 dimension is about one-third of d2. The length of the bottom surface is indicated by reference character d3 in FIG. 1. d3 is larger than d1 which,helps strengthen the shroud at d1.

Figure 4:
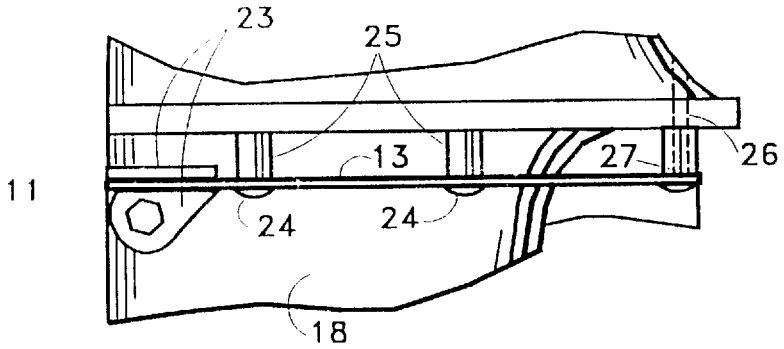
FIG. 4 is an enlarged view taken along line 4—4 of FIG. 2.

Shroud 10 is mounted coaxially around the central axis 22 of propeller 17. It is mounted at the top as shown best in FIG. 4 of the drawings. A doubler and angle 23 is welded at the front edge 11 of shroud 10. Doubler 23 is bent over and riveted to drive shaft housing 18. It is also held by bolt 24 through spacers 25 to anticavitation plate 19 preferably by four bolts. Lastly, a dowel 26 is welded at 27 to the top surface 13 of shroud 10 and dowel 26 extends upwardly as indicated by the phantom line in FIG. 4 to the drive shaft housing 18.

Shroud 10 is also connected near the tip 28 of skeg 20 by bracket 29 which is welded to the interior surface 16 adjacent the bottom surface 14. The skeg 20 extends through a slot in the forward half of shroud 10 as shown in FIGS. 1 and 3. Other holding means can be used depending upon the structure in the area of the propeller.

As viewed in FIGS. 1 and 3, shroud 10 has a cylindrical area surrounding the outer periphery of propeller 17. This reduces the normal outward water flow and improves the efficiency of the propeller, especially at low speeds and in reverse. It also provides some protection against injury to swimmers near the boat. As shown best in FIG. 3, the shroud is separated axially along the top and has a starboard edge 36 and a port edge 37. Bolts 24 surrounded by spacers 25 are positioned near these edges.

Another important feature of the present invention is the vertical inlet blades 30, 31, 32 and 33. These blades are vertically positioned as viewed from the front or rear as in FIG. 3. This is an important element in the high speed operation of the shrouded propeller. Although four inlet blades 30–33 are shown in the drawings, for smaller motors only two blades are needed. As viewed from the side in FIG. 1, the blades are angled rearwardly about 20° from the vertical. These ribs perform two important functions. First, they strengthen the shroud and reduce the chance of damage in the event of its striking objects on the bottom. Secondly, they help to deflect away underwater growth or objects. As shown in the drawings, the blades are, of course, oriented so that they have minimum water resistance and have a wider flat surface 34 as shown in FIG. 1 which faces the side of the shroud. As also shown in FIG. 1, the blades are visible from a side view and, thus, are positioned so that they deflect objects which might otherwise hit the propeller before such objects actually hit the shroud. The direction of water flow is indicated by arrow 35 and the front edge 11 is sharpened to further reduce resistance as the shroud moves through the water.

The shroud of the present invention is preferably fabricated of stainless steel or other strong, corrosion-resistant material. The stainless steel should be relatively thick such as one-eighth of an inch thick and the leading edge 11 is preferably sharpened to further reduce water resistance. The rear edge 12 is also preferably rounded to further streamline the shroud as it passes through the water.

The shroud of the present invention permits a watercraft to be operated in unexpected shallow water with greatly reduced damage to the propeller. It may be easily attached to existing outboard motors or inboard-outdrive units and actually increases the efficiency of the motor drive at low speeds and when the motor is being operated in reverse. It has almost no deleterious effect on efficiency at high speeds.

While the shroud of the present invention is shown affixed around the propeller of an outboard motor, it can equally be used around other propellers, such as around the propeller of an inboard-outdrive unit.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A propeller shroud affixable around the propeller of a watercraft, said shroud comprising:

a generally cylindrical member having an exterior surface and an interior passageway having a central axis and an interior surface, a front edge, a rear edge, a top surface and a bottom surface, and the front edge being shaped so that a side profile of the generally cylindrical member exhibits a concave-shaped front edge and means for affixing the member about a propeller and wherein the concave shaped front end is positioned so that the top surface of the generally cylindrical member is longer than the bottom surface and wherein a minimum length between the front edge and the rear edge measured parallel to the central axis is less than half the length between the front edge and the rear edge at the top surface.

2. The propeller shroud of claim 1 affixed to an outboard motor wherein said shroud is separated axially along its top surface resulting in port and starboard edges and said shroud is affixed to an outboard motor having a drive shaft housing with an anti-cavitation plate and said outboard motor having a skeg with a lower tip, and a propeller by attachment means between said port and starboard edges and said anti-cavitation plate and also between the lower tip of said skeg and the inner surface of said shroud inwardly from its bottom surface.

3. The propeller shroud of claim 1 wherein said shroud is fabricated from stainless steel with the front edge sharpened.

4. The propeller shroud of claim 1 further including a plurality of vertically positioned, as viewed from the front edge, inlet blades affixed to the interior surface adjacent the front edge thereof.

5. A propeller shroud for attachment around a propeller of a boat, said propeller shroud comprising:

a generally cylindrical member having an exterior surface and an interior passageway having a central axis and an interior surface, a front edge, a rear edge, a top surface and a bottom surface, and a plurality of inlet blades each blade being positioned in a vertical plane. said inlet blade comprising thin flat members affixed to the interior surface of said interior passageway said thin flat members having flat surfaces said thin flat members being oriented so that their flat surfaces are parallel to the central axis wherein said thin. flat members are affixed to the interior surface adjacent the front edge of the generally cylindrical member and are angled rearwardly from the top surface to the bottom surface and wherein said front edge has a concave shape when viewed from a position normal to said central axis.

6. The propeller shroud of claim 5 wherein there are four thin flat members.

* * * * *